US012152841B2

(12) United States Patent
Kanatani et al.

(10) Patent No.: US 12,152,841 B2
(45) Date of Patent: Nov. 26, 2024

(54) REFRIGERATION CYCLE APPARATUS

(71) Applicant: Mitsubishi Electric Corporation, Tokyo (JP)

(72) Inventors: Toshiki Kanatani, Tokyo (JP); Masanori Sato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 260 days.

(21) Appl. No.: 17/772,067

(22) PCT Filed: Dec. 27, 2019

(86) PCT No.: PCT/JP2019/051514
§ 371 (c)(1),
(2) Date: Apr. 26, 2022

(87) PCT Pub. No.: WO2021/131038
PCT Pub. Date: Jul. 1, 2021

(65) Prior Publication Data

US 2022/0299276 A1 Sep. 22, 2022

(51) Int. Cl.
*F28F 1/32* (2006.01)
*F25B 39/00* (2006.01)
(Continued)

(52) U.S. Cl.
CPC ..... *F28F 1/32* (2013.01); *F25B 39/00* (2013.01); *F28D 1/053* (2013.01); *F28D 2021/0068* (2013.01)

(58) Field of Classification Search
CPC ..... F28F 1/32; F28F 9/0275; F28D 1/05325; F28D 1/053; F28D 2021/0068; F25B 39/00; F25B 13/00
See application file for complete search history.

(56) References Cited

U.S. PATENT DOCUMENTS 5,542,271 A 8/1996 Kudoh et al.
2016/0010905 A1* 1/2016 Wang ..... F25B 39/028

FOREIGN PATENT DOCUMENTS

EP 3404345 A2 11/2018
JP 58-062469 A 4/1983
(Continued)

OTHER PUBLICATIONS

Pdf is translation of foreign reference JP 07098162 A (Year: 1995).*
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

A first heat exchanger is a heat exchanger that exchanges heat between refrigerant and gas. The first heat exchanger includes a first group of first heat transfer tubes, a second group of first heat transfer tubes, a first group of second heat transfer tubes, and a second group of second heat transfer tubes. The first group of first heat transfer tubes are arranged side by side in a third direction and connected to each other in series. The second group of first heat transfer tubes are arranged side by side in the third direction and connected to each other in series. The first group of second heat transfer tubes are arranged side by side in the third direction and connected to each other in series. The second group of second heat transfer tubes are arranged side by side in the third direction and connected to each other in series.

9 Claims, 4 Drawing Sheets

(51) Int. Cl.
*F28D 1/053* (2006.01)
*F28D 21/00* (2006.01)

(56) References Cited

FOREIGN PATENT DOCUMENTS

| | | | | | |
|---|---|---|---|---|---|
| JP | 60-096550 | U | | 7/1985 | |
| JP | 07098162 | A | * | 4/1995 | ..... F25B 1/00 |
| JP | H-07098162 | A | * | 4/1995 | ..... F25B 1/00 |
| JP | 2007-163013 | A | | 6/2007 | |
| JP | 2015-141009 | A | | 8/2015 | |
| JP | 2018-185116 | A | | 11/2018 | |

OTHER PUBLICATIONS

Pdf is translation of foreign reference JPH 07098162 A (Year: 1995).*
Office Action dated Oct. 7, 2022 issued in corresponding IN Patent Application No. 202227034963 (and English translation).
Office Action mailed Jul. 4, 2023 in corresponding Japanese Patent Application No. 2021-566738 (and English Translation).
International Search Report of the International Searching Authority mailed Feb. 25, 2020 for the corresponding International Patent Application No. PCT/JP2019/051514 (and English translation).
Office Action dated for Nov. 16, 2022 issued in corresponding European Patent Application No. 19957728.9.

* cited by examiner

REFRIGERATION CYCLE APPARATUS

CROSS REFERENCE TO RELATED APPLICATION

This application is a U.S. national stage application of International Patent Application No. PCT/JP2019/051514 filed on Dec. 27, 2019, the disclosure of which is incorporated herein by reference.

TECHNICAL FIELD

The present invention relates to a heat exchanger and a refrigeration cycle apparatus.

BACKGROUND

Non-azeotropic mixed refrigerant is a mixture of refrigerant having a high boiling point and refrigerant having a low boiling point. Therefore, in the non-azeotropic mixed refrigerant, a saturation temperature varies depending on a degree of dryness, because the refrigerant having a low boiling point is gasified in a region where the degree of dryness is low, and the refrigerant having a high boiling point is gasified in a region where the degree of dryness is high. As a result, unlike single refrigerant, in the non-azeotropic mixed refrigerant, a saturation gas temperature at the same pressure is higher than a saturation liquid temperature. That is, in a Mollier diagram (p-h diagram), an isothermal line of the non-azeotropic mixed refrigerant has a gradient in a two-phase region (hereinafter, referred to as "temperature gradient").

On the refrigerant flow inlet side of an evaporator of a refrigeration cycle apparatus, heat exchange is performed between two-phase refrigerant having a relatively low temperature and gas (e.g., outdoor air) having a higher temperature than that of the refrigerant, to thereby raise a degree of dryness of the two-phase refrigerant. When the refrigerant circulating in the refrigeration cycle apparatus is non-azeotropic mixed refrigerant, an influence of the above-described temperature gradient makes a saturation temperature of the non-azeotropic mixed refrigerant on the refrigerant flow outlet side of the evaporator higher than a saturation temperature of the non-azeotropic mixed refrigerant on the refrigerant flow inlet side of the evaporator. This makes a temperature difference between the non-azeotropic mixed refrigerant and the gas flowing on the refrigerant flow outlet side of the evaporator smaller than a temperature difference between the non-azeotropic mixed refrigerant and the outdoor air flowing on the refrigerant flow inlet side of the evaporator, and thus, an amount of heat exchange on the refrigerant flow outlet side of the evaporator becomes smaller than an amount of heat exchange on the refrigerant flow inlet side of the evaporator.

Examples of a method for enhancing heat exchange performance of an evaporator include causing a flow direction of refrigerant and a flow direction of outdoor air to form a so-called counter flow. However, in a refrigeration cycle apparatus in which switching between a second state in which the flow direction of the refrigerant is inverted and a heat exchanger functions as a condenser and a first state in which the heat exchanger functions as an evaporator is performed by, for example, a four-way valve or the like, a so-called parallel flow is formed in the condenser in the second state when a counter flow is achieved in the evaporator in the first state, which leads to degradation in heat exchange performance of the condenser.

Japanese Patent Laying-Open No. 58-62469 discloses a heat exchanger in which a refrigerant flow path in the heat exchanger is divided into two portions at a central portion thereof, and the portion located on one side relative to the central portion and the portion located on the other side relative to the central portion face the windward side when the heat exchanger functions both as a condenser and as an evaporator, in order to enhance heat exchange performance in each of the above-described second state and the above-described first state.

PATENT LITERATURE

PTL 1: Japanese Patent Laying-Open No. 58-62469

However, in the heat exchanger described in Japanese Patent Laying-Open No. 58-62469, the refrigerant flow path located on the refrigerant flow inlet side relative to the central portion when the heat exchanger functions as an evaporator is formed by alternately connecting in series heat transfer tubes located on the relatively windward side and heat transfer tubes located on the relatively leeward side. Therefore, a region where the refrigerant flows from the heat transfer tube located on the relatively windward side to the heat transfer tube located on the relatively leeward side to form a so-called parallel flow and a region where the refrigerant flows from the heat transfer tube located on the relatively leeward side to the heat transfer tube located on the relatively windward side to form a so-called counter flow are alternately arranged in the above-described refrigerant flow path. The parallel flow refers to a flow of the refrigerant from the windward side to the leeward side in a flow direction of gas. The counter flow refers to a flow of the refrigerant from the leeward side to the windward side in the flow direction of the gas.

As a result, in the above-described heat exchanger, the refrigerant having a low temperature flows through the heat transfer tube located on the relatively windward side in the above-described refrigerant flow path, and thus, frost formation is likely to occur around this heat transfer tube. As a result, in a refrigeration cycle apparatus including the above-described heat exchanger, the number of times of defrosting operation is comparatively large, which makes it difficult to sufficiently enhance heat exchange performance and comfortability.

SUMMARY

A main object of the present invention is to provide a heat exchanger in which even when the heat exchanger is used in a refrigeration cycle apparatus in which non-azeotropic mixed refrigerant circulates, frost formation is suppressed and degradation in heat exchange performance in each of the above-described second state and the above-described first state is suppressed, as compared with the above-described conventional heat exchanger, and to provide a refrigeration cycle apparatus including such a heat exchanger.

A heat exchanger according to the present invention is a heat exchanger that exchanges heat between refrigerant flowing in a first direction and gas flowing in a second direction crossing the first direction, the heat exchanger including: a plurality of first heat transfer tubes and a plurality of second heat transfer tubes which extend along the first direction and through which the refrigerant flows; and at least one fin connected with each of the plurality of first heat transfer tubes and the plurality of second heat transfer tubes, and provided to form, around each of the plurality of first heat transfer tubes and the plurality of second heat transfer tubes, an air passage in which the gas flows in the second direction. The plurality of first heat transfer tubes include a first group of first heat transfer tubes arranged side by side in a third direction and connected to each other in series, and a second group of first heat transfer tubes arranged side by side in the third direction and connected to each other in series. The first group of first heat transfer tubes are connected in series to the second group of first heat transfer tubes, and arranged leeward of the second group of first heat transfer tubes in the second direction. The plurality of second heat transfer tubes include a first group of second heat transfer tubes arranged side by side in the third direction and connected to each other in series, and a second group of second heat transfer tubes arranged side by side in the third direction and connected to each other in series. The first group of second heat transfer tubes are connected in series to the second group of second heat transfer tubes, and arranged leeward of the second group of second heat transfer tubes in the second direction. The first group of first heat transfer tubes, the second group of first heat transfer tubes, the second group of second heat transfer tubes, and the first group of second heat transfer tubes are connected in series in this order.

According to the present invention, there can be provided a heat exchanger in which even when the heat exchanger is used in a refrigeration cycle apparatus in which non-azeotropic mixed refrigerant circulates, frost formation is suppressed and degradation in heat exchange performance in each of the above-described second state and the above-described first state is suppressed, as compared with the above-described conventional heat exchanger, and there can be provided a refrigeration cycle apparatus including such a heat exchanger.

DETAILED DESCRIPTION

Figure 1:
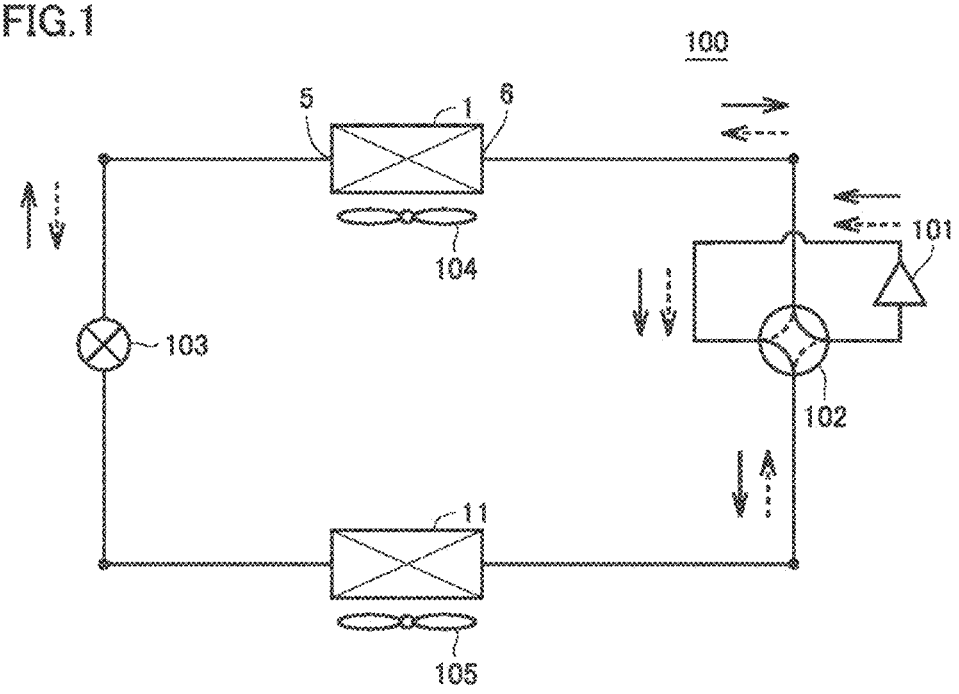
FIG. 1 shows a refrigeration cycle apparatus according to a first embodiment.

Embodiments of the present invention will be described hereinafter with reference to the drawings, in which the same or corresponding portions are denoted by the same reference characters and description thereof will not be repeated in principle.

First Embodiment

Configuration of Refrigeration Cycle Apparatus

As shown in FIG. 1, a refrigeration cycle apparatus 100 according to a first embodiment includes a refrigerant circuit in which refrigerant circulates. The refrigerant circuit includes a compressor 101, a four-way valve 102 serving as a flow path switching portion, a decompressing portion 103, a first heat exchanger 1A, and a second heat exchanger 11. Refrigeration cycle apparatus 100 further includes a first fan 104 that blows air to first heat exchanger 1A, and a second fan 105 that blows air to second heat exchanger 11. Refrigeration cycle apparatus 100 is, for example, an air conditioner. First heat exchanger 1A is, for example, an outdoor heat exchanger. Second heat exchanger 11 is, for example, an indoor heat exchanger.

Compressor 101 has a discharge port through which the refrigerant is discharged, and a suction port through which the refrigerant is suctioned. Decompressing portion 103 is, for example, an expansion valve. Decompressing portion 103 is connected to a first flow inlet/outlet portion 5 of first heat exchanger 1A. First fan 104 forms, on first heat exchanger 1A, an air flow along a below-described second direction B.

Four-way valve 102 has a first port connected to the discharge port of compressor 101 via a discharge pipe, a second port connected to the suction port of compressor 101 via a suction pipe, a third port connected to a second flow inlet/outlet portion 6 of first heat exchanger 1A, and a fourth port connected to second heat exchanger 11. Four-way valve 102 is provided to perform switching between a first state in which second heat exchanger 11 functions as a condenser and first heat exchanger 1A functions as an evaporator, and a second state in which first heat exchanger 1A functions as a condenser and second heat exchanger 11 functions as an evaporator. When refrigeration cycle apparatus 100 is an air conditioner, the first state is achieved at the time of heating operation, and the second state is achieved at the time of cooling operation. In the first state and the second state, a direction of the air flow formed on first heat exchanger 1A by first fan 104 is constant.

Solid line arrows shown in FIG. 1 indicate a flow direction of the refrigerant that circulates in the above-described refrigerant circuit, when refrigeration cycle apparatus 100 is in the above-described first state. Dotted line arrows shown in FIG. 1 indicate a flow direction of the refrigerant that circulates in the above-described refrigerant circuit, when refrigeration cycle apparatus 100 is in the above-described second state.

Configuration of First Heat Exchanger

Figure 2:
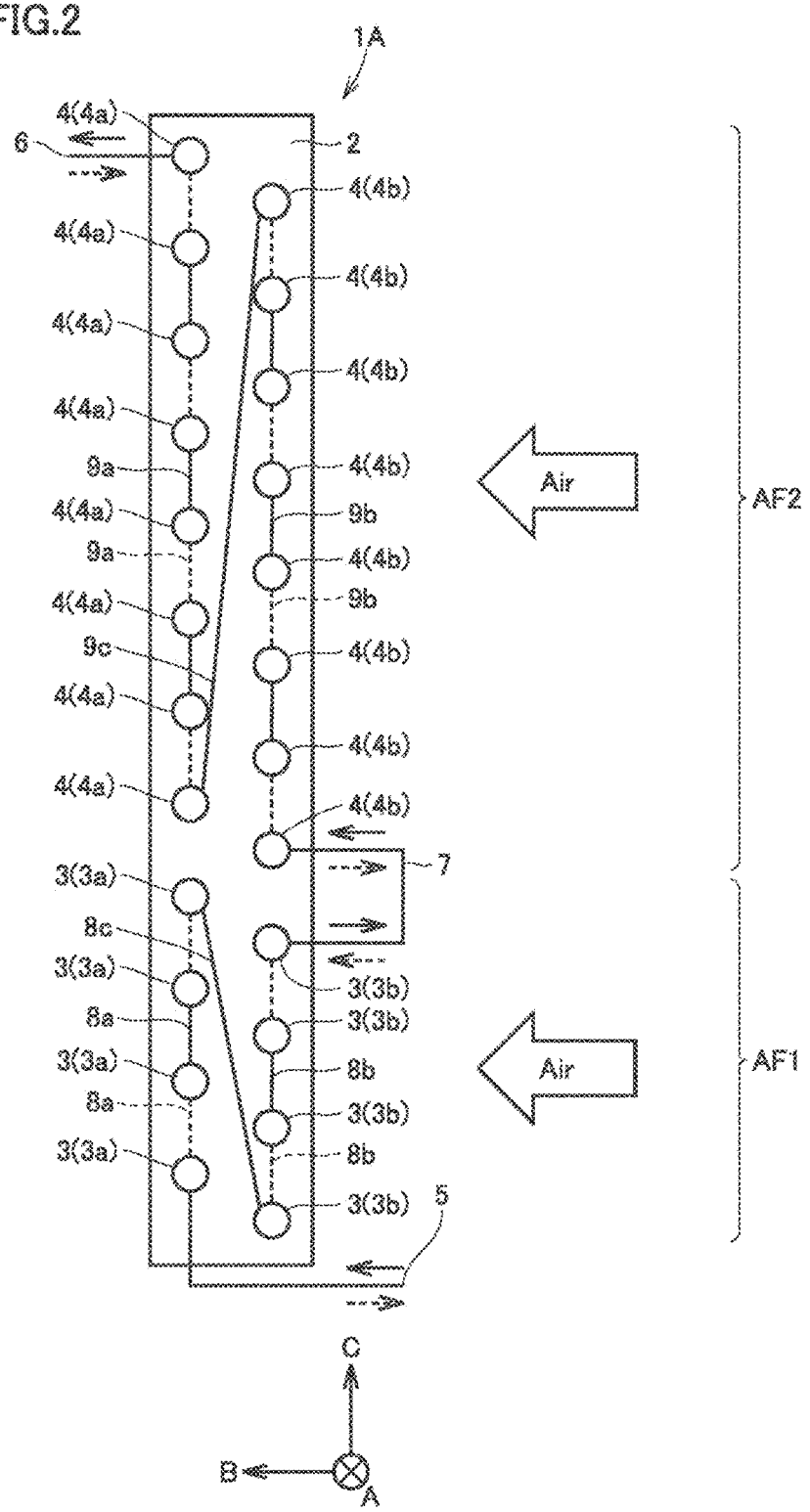
FIG. 2 is a side view showing arrangement of a plurality of heat transfer tubes of a heat exchanger according to the first embodiment.

As shown in FIG. 2, first heat exchanger 1A mainly includes, for example, a plurality of fins 2, a plurality of first heat transfer tubes 3, a plurality of second heat transfer tubes 4, first flow inlet/outlet portion 5, second flow inlet/outlet portion 6, a flow path switching portion 7, and a plurality of connection portions 8 and 9. First heat exchanger 1A is provided to exchange heat between the refrigerant flowing through each of the plurality of first heat transfer tubes 3 and the plurality of second heat transfer tubes 4 along a first direction A and gas (e.g., outdoor air) flowing along the plurality of fins 2 along second direction B.

First direction A is a direction that crosses second direction B, e.g., is orthogonal to second direction B. First direction A and second direction B are, for example, horizontal directions. A third direction C that crosses first direction A and second direction B is, for example, a vertical direction. FIG. 2 is a side view when first heat exchanger 1A is viewed from first direction A. In FIG. 2, the gas flows from the right side to the left side with respect to first heat exchanger 1A.

As shown in FIG. 2, each of the plurality of fins 2 extends along second direction B and third direction C. The plurality of fins 2 are spaced apart from each other in first direction A. Each of the plurality of fins 2 is connected to each of the plurality of first heat transfer tubes 3 and the plurality of second heat transfer tubes 4. Each of the plurality of fins 2 is provided to form, around each of the plurality of first heat transfer tubes 3, a first air passage AF1 through which the gas flows in second direction B, and to form, around each of the plurality of second heat transfer tubes 4, a second air passage AF2 through which the gas flows in second direction B.

As shown in FIG. 2, each of the plurality of first heat transfer tubes 3 extends along first direction A. The plurality of first heat transfer tubes 3 are spaced apart from each other and arranged side by side in second direction B and third direction C. The plurality of first heat transfer tubes 3 include a first group of first heat transfer tubes 3*a* and a second group of first heat transfer tubes 3*b*. First air passage AF1 is formed around the first group of first heat transfer tubes 3*a* and the second group of first heat transfer tubes 3*b*.

As shown in FIG. 2, each of the plurality of second heat transfer tubes 4 extends along first direction A. The plurality of second heat transfer tubes 4 are spaced apart from each other and arranged side by side in second direction B and third direction C. The plurality of second heat transfer tubes 4 include a first group of second heat transfer tubes 4*a* and a second group of second heat transfer tubes 4*b*. Second air passage AF2 is formed around the first group of second heat transfer tubes 4*a* and the second group of second heat transfer tubes 4*b*.

First air passage AF1 and second air passage AF2 are arranged side by side in third direction C. The gas blown by first fan 104 flows through first air passage AF1 and second air passage AF2. A part of the gas blown by first fan 104 flows through first air passage AF1, and the other part flows through second air passage AF2. A direction of an air flow flowing through first air passage AF1 is the same as a direction of an air flow flowing through second air passage AF2. First air passage AF1 is continuous to second air passage AF2.

First heat transfer tubes 3*a* of the first group of first heat transfer tubes 3*a* are spaced apart from each other and arranged side by side in third direction C. First heat transfer tubes 3*b* of the second group of first heat transfer tubes 3*b* are spaced apart from each other and arranged side by side in third direction C. Each first heat transfer tube 3*a* of the first group of first heat transfer tubes 3*a* is arranged on the leeward side of first air passage AF1 relative to each first heat transfer tube 3*b* of the second group of first heat transfer tubes 3*b* in second direction B. Each first heat transfer tube 3*b* of the second group of first heat transfer tubes 3*b* is arranged on the windward side of first air passage AF1 relative to each first heat transfer tube 3*a* of the first group of first heat transfer tubes 3*a* in second direction B.

Second heat transfer tubes 4*a* of the first group of second heat transfer tubes 4*a* are spaced apart from each other and arranged side by side in third direction C. Second heat transfer tubes 4*b* of the second group of second heat transfer tubes 4*b* are spaced apart from each other and arranged side by side in third direction C. Each second heat transfer tube 4*a* of the first group of second heat transfer tubes 4*a* is arranged on the leeward side of second air passage AF2 relative to each second heat transfer tube 4*b* of the second group of second heat transfer tubes 4*b* in second direction B. Each second heat transfer tube 4*b* of the second group of second heat transfer tubes 4*b* is arranged on the windward side of second air passage AF2 relative to each second heat transfer tube 4*a* of the first group of second heat transfer tubes 4*a* in second direction B.

The first group of first heat transfer tubes 3*a* are spaced apart from and arranged side by side with the first group of second heat transfer tubes 4*a* in third direction C. The first group of first heat transfer tubes 3*a* are arranged below the first group of second heat transfer tubes 4*a*.

The second group of first heat transfer tubes 3*b* are spaced apart from and arranged side by side with the second group of second heat transfer tubes 4*b* in third direction C. The second group of first heat transfer tubes 3*b* are arranged below the second group of second heat transfer tubes 4*b*.

The first group of first heat transfer tubes 3*a*, the second group of first heat transfer tubes 3*b*, the second group of second heat transfer tubes 4*b*, and the first group of second heat transfer tubes 4*a* are connected in series in this order.

First heat transfer tubes 3*a* of the first group of first heat transfer tubes 3*a* are connected to each other in series via connection portions 8*a*. First heat transfer tubes 3*b* of the second group of first heat transfer tubes 3*b* are connected to each other in series via connection portions 8*b*. The first group of first heat transfer tubes 3*a* are connected in series to the second group of first heat transfer tubes 3*b* via a connection portion 8*c* (first connection pipe). The first group of first heat transfer tubes 3*a* and the plurality of connection portions 8*a* form a first refrigerant flow path. The second group of first heat transfer tubes 3*b* and the plurality of connection portions 8*b* form a second refrigerant flow path. The first refrigerant flow path is connected in series to the second refrigerant flow path via connection portion 8*c*.

Second heat transfer tubes 4*a* of the first group of second heat transfer tubes 4*a* are connected to each other in series via connection portions 9*a*. Second heat transfer tubes 4*b* of the second group of second heat transfer tubes 4*b* are connected to each other in series via connection portions 9*b*. The first group of second heat transfer tubes 4*a* are connected in series to the second group of second heat transfer tubes 4*b* via a connection portion 9*c* (second connection pipe). The first group of second heat transfer tubes 4*a* and the plurality of connection portions 9*a* form a third refrigerant flow path. The second group of second heat transfer tubes 4*b* and the plurality of connection portions 9*b* form a fourth refrigerant flow path. The fourth refrigerant flow path is connected in series to the third refrigerant flow path via connection portion 9*c*.

The second group of first heat transfer tubes 3*b* are connected in series to the second group of second heat transfer tubes 4*b* via flow path switching portion 7. The second refrigerant flow path is connected in series to the fourth refrigerant flow path via flow path switching portion 7.

As described above, a refrigerant flow path in first heat exchanger 1A is formed by connecting the first refrigerant flow path, the second refrigerant flow path, the fourth refrigerant flow path, and the third refrigerant flow path in series in this order.

Preferably, a total sum of lengths of the plurality of first heat transfer tubes 3 in first direction A is shorter than a total sum of lengths of the plurality of second heat transfer tubes 4 in first direction A. The lengths of first heat transfer tubes 3 in first direction A are, for example, equal to each other. The lengths of second heat transfer tubes 4 in first direction A are, for example, equal to each other. The length of each first heat transfer tube 3 in first direction A is equal to the length of each second heat transfer tube 4 in first direction A. Preferably, the number of first heat transfer tubes 3 is smaller than the number of second heat transfer tubes 4. The number of the first group of first heat transfer tubes 3*a* is smaller than the number of the first group of second heat transfer tubes 4*a*. The number of the second group of first heat transfer tubes 3*b* is smaller than the number of the second group of second heat transfer tubes 4*b*. The number of the first group of first heat transfer tubes 3*a* is, for example, equal to the number of the second group of first heat transfer tubes 3*b*. The number of the first group of second heat transfer tubes 4*a* is, for example, equal to the number of the second group of second heat transfer tubes 4*b*.

Each first heat transfer tube 3*a* of the first group of first heat transfer tubes 3*a* is, for example, arranged between two first heat transfer tubes 3*b* of the second group of first heat transfer tubes 3*b* that are adjacent in third direction C, when viewed from second direction B. Each first heat transfer tube 3*b* of the second group of first heat transfer tubes 3*b* is arranged between two first heat transfer tubes 3*a* of the first group of first heat transfer tubes 3*a* that are adjacent in third direction C, when viewed from second direction B.

First heat transfer tube 3*a* of the first group of first heat transfer tubes 3*a* located at a lowermost position is, for example, arranged above first heat transfer tube 3*b* of the second group of first heat transfer tubes 3*b* located at a lowermost position. First heat transfer tube 3*a* of the first group of first heat transfer tubes 3*a* located at an uppermost position is, for example, arranged above first heat transfer tube 3*b* of the second group of first heat transfer tubes 3*b* located at an uppermost position.

Second heat transfer tube 4*a* of the first group of second heat transfer tubes 4*a* located at a lowermost position is, for example, arranged above second heat transfer tube 4*b* of the second group of second heat transfer tubes 4*b* located at a lowermost position. Second heat transfer tube 4*a* of the first group of second heat transfer tubes 4*a* located at an uppermost position is, for example, arranged above second heat transfer tube 4*b* of the second group of second heat transfer tubes 4*b* located at an uppermost position. Second heat transfer tube 4*b* of the second group of second heat transfer tubes 4*b* located at the lowermost position is, for example, arranged above first heat transfer tube 3*a* of the first group of first heat transfer tubes 3*a* located at the uppermost position.

Each second heat transfer tube 4*a* of the first group of second heat transfer tubes 4*a* is, for example, arranged between two second heat transfer tubes 4*b* of the second group of second heat transfer tubes 4*b* that are adjacent in third direction C, when viewed from second direction B. Each second heat transfer tube 4*b* of the second group of second heat transfer tubes 4*b* is, for example, arranged between two second heat transfer tubes 4*a* of the first group of second heat transfer tubes 4*a* that are adjacent in third direction C, when viewed from second direction B.

First heat transfer tube 3*a* of the first group of first heat transfer tubes 3*a* arranged at the uppermost position is arranged between first heat transfer tube 3*b* of the second group of first heat transfer tubes 3*b* arranged at the uppermost position and second heat transfer tube 4*b* of the second group of second heat transfer tubes 4*b* arranged at the lowermost position, when viewed from second direction B.

Second heat transfer tube 4*b* of the second group of second heat transfer tubes 4*b* arranged at the lowermost position and first heat transfer tube 3*a* of the first group of first heat transfer tubes 3*a* arranged at the uppermost position are arranged between first heat transfer tube 3*b* of the second group of first heat transfer tubes 3*b* arranged at the uppermost position and second heat transfer tube 4*a* of the first group of second heat transfer tubes 4*a* arranged at the lowermost position, when viewed from second direction B.

Each of the plurality of first heat transfer tubes 3 is not arranged side by side with each of the plurality of second heat transfer tubes 4 in second direction B. Each of the first group of first heat transfer tubes 3*a* is not arranged windward and leeward of each of the first group of second heat transfer tubes 4*a* and the second group of second heat transfer tubes 4*b* in second direction B. Each of the first group of second heat transfer tubes 4*a* is not arranged windward and leeward of each of the first group of first heat transfer tubes 3*a* and the second group of first heat transfer tubes 3*b* in second direction B.

In other words, first air passage AF1 and second air passage AF2 are arranged in parallel. The gas flowing into first air passage AF1 is first subjected to heat exchange with the refrigerant flowing through the second group of first heat transfer tubes 3*b*, and then, is subjected to heat exchange with the refrigerant flowing through the first group of first heat transfer tubes 3*a*, and then, flows out of first air passage AF1. The gas flowing into second air passage AF2 is first subjected to heat exchange with the refrigerant flowing through the second group of second heat transfer tubes 4*b*, and then, is subjected to heat exchange with the refrigerant flowing through the first group of second heat transfer tubes 4*a*, and then, flows out of second air passage AF2.

The features of the plurality of first heat transfer tubes 3 and the plurality of second heat transfer tubes 4 other than the above-described features are, for example, equal to each other. Flow path cross-sectional areas of the plurality of first heat transfer tubes 3 and the plurality of second heat transfer tubes 4 are, for example, equal to each other.

The first group of first heat transfer tubes 3*a* are, for example, equally spaced apart from each other in third direction C. The second group of first heat transfer tubes 3*b* are, for example, equally spaced apart from each other in third direction C. The first group of second heat transfer tubes 4*a* are, for example, equally spaced apart from each other in third direction C. The second group of second heat transfer tubes 4*b* are, for example, equally spaced apart from each other in third direction C. A distance between two first heat transfer tubes 3*a* that are adjacent in third direction C is, for example, equal to a distance between two first heat transfer tubes 3*b* that are adjacent in third direction C. A distance between two second heat transfer tubes 4*a* that are adjacent in third direction C is, for example, equal to a distance between two second heat transfer tubes 4*b* that are adjacent in third direction C. The distance between two first heat transfer tubes 3*a* that are adjacent in third direction C, the distance between two first heat transfer tubes 3*b* that are adjacent in third direction C, the distance between two second heat transfer tubes 4*a* that are adjacent in third direction C, the distance between two second heat transfer tubes 4*b* that are adjacent in third direction C, a distance between first heat transfer tube 3*a* and second heat transfer tube 4*a* that are adjacent in third direction C, and a distance between first heat transfer tube 3*b* and second heat transfer tube 4*b* that are adjacent in third direction C are, for example, equal to each other.

The first group of first heat transfer tubes 3*a* and the first group of second heat transfer tubes 4*a* are, for example, arranged on a straight line extending along third direction C. The second group of first heat transfer tubes 3*b* and the second group of second heat transfer tubes 4*b* are, for example, arranged on a straight line extending along third direction C. A distance between the first group of first heat transfer tubes 3*a* and the second group of first heat transfer tubes 3*b* in second direction B is, for example, equal to a distance between the first group of second heat transfer tubes 4*a* and the second group of second heat transfer tubes 4*b* in second direction B.

Each of first flow inlet/outlet portion 5 and second flow inlet/outlet portion 6 is a portion through which the refrigerant flows into or out of the above-described refrigerant flow path of first heat exchanger 1A. First flow inlet/outlet portion 5 is connected to first heat transfer tube 3*a* of the first group of first heat transfer tubes 3*a* located at the lowermost position. In other words, first flow inlet/outlet portion 5 is connected to a lower end of the first refrigerant flow path. Second flow inlet/outlet portion 6 is connected to second heat transfer tube 4*a* of the first group of second heat transfer tubes 4*a* located at the uppermost position. In other words, second flow inlet/outlet portion 6 is connected to an upper end of the third refrigerant flow path.

Solid line arrows shown in FIG. 2 indicate the flow direction of the refrigerant that circulates in the above-described refrigerant circuit, when refrigeration cycle apparatus 100 is in the above-described first state. Dotted line arrows shown in FIG. 2 indicate the flow direction of the refrigerant that circulates in the above-described refrigerant circuit, when refrigeration cycle apparatus 100 is in the above-described second state. First flow inlet/outlet portion 5 is connected to the above-described refrigerant circuit to function as a flow inlet portion through which the refrigerant flows in in the above-described first state, and function as a flow outlet portion through which the refrigerant flows out in the above-described second state. Second flow inlet/outlet portion 6 is connected to the above-described refrigerant circuit to function as a flow outlet portion through which the refrigerant flows out in the above-described first state, and function as a flow inlet portion through which the refrigerant flows in in the above-described second state.

Flow path switching portion 7 is a portion that connects first heat transfer tube 3 corresponding to first air passage AF1 to second heat transfer tube 4 corresponding to second air passage AF2 in series. First heat exchanger 1A does not necessarily need to include flow path switching portion 7.

Each of the plurality of connection portions 8*a* connects one ends or the other ends in first direction A of two first heat transfer tubes 3*a* of the first group of first heat transfer tubes 3 that are adjacent in third direction C. Each of the plurality of connection portions 8*b* connects one ends or the other ends in first direction A of two first heat transfer tubes 3*b* of the second group of first heat transfer tubes 3*b* that are adjacent in third direction C. Connection portion 8*c* connects one ends or the other ends in first direction A of first heat transfer tube 3*a* of the first group of first heat transfer tubes 3*a* located at the uppermost position and first heat transfer tube 3*b* of the second group of first heat transfer tubes 3*b* located at the lowermost position. One end in first direction A of first heat transfer tube 3*a* of the first group of first heat transfer tubes 3*a* located at the uppermost position is connected to first heat transfer tube 3*a* that is adjacent to that first heat transfer tube 3*a* in third direction C, via connection portion 8*a*. The other end in first direction A of first heat transfer tube 3*a* of the first group of first heat transfer tubes 3*a* located at the uppermost position is connected to the other end in first direction A of first heat transfer tube 3*b* of the second group of first heat transfer tubes 3*b* located at the lowermost position, via connection portion 8*c*.

Each of the plurality of connection portions 9*a* connects one ends or the other ends in first direction A of two second heat transfer tubes 4*a* of the first group of second heat transfer tubes 4*a* that are adjacent in third direction C. Each of the plurality of connection portions 9*b* connects one ends or the other ends in first direction A of two second heat transfer tubes 4*b* of the second group of second heat transfer tubes 4*b* that are adjacent in third direction C. Connection portion 9*c* connects one ends or the other ends in first direction A of second heat transfer tube 4*a* of the first group of second heat transfer tubes 4*a* located at the lowermost position and second heat transfer tube 4*b* of the second group of second heat transfer tubes 4*b* located at the uppermost position. One end in first direction A of second heat transfer tubes 4*a* of the first group of second heat transfer tubes 4*a* located at the lowermost position is connected to second heat transfer tube 4*a* that is adjacent to that second heat transfer tube 4*a* in third direction C, via connection portion 9*a*. The other end in first direction A of second heat transfer tube 4*a* of the first group of second heat transfer tubes 4*a* located at the lowermost position is connected to the other end in first direction A of second heat transfer tube 4*b* of the second group of second heat transfer tubes 4*b* located at the uppermost position, via connection portion 9*c*.

In FIG. 2, connection portions 8*a*, 8*b*, 8*c*, 9*a*, 9*b*, and 9*c* indicated by dotted lines are connected to one ends of the plurality of first heat transfer tubes 3 and the plurality of second heat transfer tubes 4, and connection portions 8*a*, 8*b*, 8*c*, 9*a*, 9*b*, and 9*c* indicated by solid lines are connected to the other ends of the plurality of first heat transfer tubes 3 and the plurality of second heat transfer tubes 4.

Function and Effect

In the refrigerant flow path of the above-described conventional heat exchanger, the upstream portion arranged on the refrigerant inflow side relative to the central portion of the refrigerant flow path when the heat exchanger functions as an evaporator is formed by alternately connecting in series the heat transfer tubes arranged on the windward side and the heat transfer tubes arranged on the leeward side. From a different perspective, in the upstream portion when the heat exchanger functions as an evaporator, the two heat transfer tubes arranged to form a counter flow and the two heat transfer tubes arranged to form a parallel flow are alternately connected in series. Thus, in the above-described upstream portion of the above-described conventional heat exchanger, a temperature difference between the comparatively-low-temperature refrigerant flowing through the heat transfer tubes arranged on the windward side and the high-temperature gas flowing around those heat transfer tubes is large, which is likely to cause frost formation.

In contrast, first heat exchanger 1A does not include the above-described upstream portion of the above-described conventional heat exchanger. Specifically, the plurality of first heat transfer tubes 3 of first heat exchanger 1A include the first group of first heat transfer tubes 3*a* arranged side by side in third direction C and connected to each other in series, and the second group of first heat transfer tubes 3*b* arranged side by side in third direction C and connected to each other in series. The first group of first heat transfer tubes 3*a* are connected in series to the second group of first heat transfer tubes 3*b*, and arranged on the leeward side of first air passage AF1 relative to the second group of first heat transfer tubes 3*b* in second direction B. The plurality of second heat transfer tubes 4 include the first group of second heat transfer tubes 4*a* arranged side by side in third direction C and connected to each other in series, and the second group of second heat transfer tubes 4*b* arranged side by side in third direction C and connected to each other in series. The first group of second heat transfer tubes 4*a* are connected in series to the second group of second heat transfer tubes 4*b*, and arranged on the leeward side of second air passage AF2 relative to the second group of second heat transfer tubes 4*b* in second direction B. The first group of first heat transfer tubes 3*a*, the second group of first heat transfer tubes 3*b*, the second group of second heat transfer tubes 4*b*, and the first group of second heat transfer tubes 4*a* are connected in series in this order. From a different perspective, each of the plurality of first heat transfer tubes 3 is not arranged to form a parallel flow in the upstream portion (first air passage AF1) arranged on the refrigerant inflow side relative to the central portion of first heat exchanger 1A in third direction C when first heat exchanger 1A functions as an evaporator.

Therefore, when first heat exchanger 1A functions as an evaporator, a temperature of the refrigerant flowing through the second group of first heat transfer tubes 3*b* arranged on the windward side of first air passage AF1 is higher than a temperature of the refrigerant flowing through the first group of first heat transfer tubes 3*a* arranged on the leeward side. Furthermore, a temperature of the refrigerant flowing through the second group of second heat transfer tubes 4*b* arranged on the windward side of second air passage AF2 is even higher than a temperature of the refrigerant flowing through the second group of first heat transfer tubes 3*b* arranged on the windward side of first air passage AF1.

Furthermore, of the first group of first heat transfer tubes 3*a*, the second group of first heat transfer tubes 3*b*, the second group of second heat transfer tubes 4*b*, and the first group of second heat transfer tubes 4*a*, the first group of first heat transfer tubes 3*a* through which the refrigerant having the lowest temperature flows because the first group of first heat transfer tubes 3*a* are arranged on the most upstream side when first heat exchanger 1A functions as an evaporator are arranged leeward of the second group of first heat transfer tubes 3*b*. Therefore, a temperature of the gas flowing around the first group of first heat transfer tubes 3*a* is lower than a temperature of the gas flowing around the second group of first heat transfer tubes 3*b*.

As a result, in first heat exchanger 1A, frost formation is suppressed as compared with the above-described conventional heat exchanger.

Figure 3:
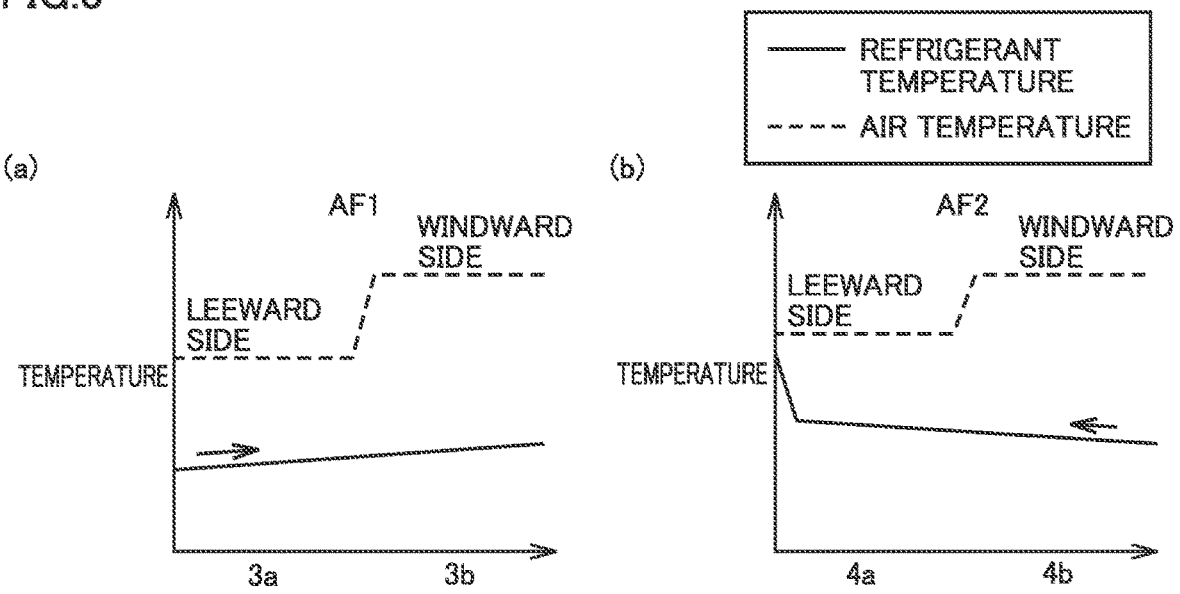
FIG. 3(*a*) is a graph showing temperature changes of non-azeotropic mixed refrigerant and air that are subjected to heat exchange in a first air passage of the heat exchanger when the heat exchanger according to the first embodiment functions as an evaporator, and FIG. 3(*b*) is a graph showing temperature changes of the non-azeotropic mixed refrigerant and the air that are subjected to heat exchange in a second air passage of the heat exchanger when the heat exchanger according to the first embodiment functions as an evaporator.

FIG. 3(*a*) is a graph showing temperature changes of non-azeotropic mixed refrigerant flowing through the plurality of first heat transfer tubes 3 and gas flowing through first air passage AF1, when the non-azeotropic mixed refrigerant flows through first heat exchanger 1A that functions as an evaporator. FIG. 3(*b*) is a graph showing temperature changes of non-azeotropic mixed refrigerant flowing through the plurality of second heat transfer tubes 4 and gas flowing through second air passage AF2, when the non-azeotropic mixed refrigerant flows through first heat exchanger 1A that functions as an evaporator. The horizontal axis in each of FIGS. 3(*a*) and 3(*b*) indicates a flow direction of the gas, with the right side of the horizontal axis corresponding to the windward side and the left side of the horizontal axis corresponding to the leeward side. In FIG. 3(*a*), the refrigerant flowing from the first refrigerant flow path to the second refrigerant flow path flows from the left side to the right side along an arrow. In FIG. 3(*b*), the refrigerant flowing from the fourth refrigerant flow path to the third refrigerant flow path flows from the right side to the left side along an arrow. The vertical axis in each of FIGS. 3(*a*) and 3(*b*) indicates temperatures of the non-azeotropic mixed refrigerant and the gas.

When first heat exchanger 1A functions as an evaporator, the low-temperature two-phase refrigerant decompressed by decompressing portion 103 flows into first heat exchanger 1A through first flow inlet/outlet portion 5. In first heat exchanger 1A, the refrigerant flows through the first refrigerant flow path, connection portion 8*c*, the second refrigerant flow path, flow path switching portion 7, the fourth refrigerant flow path, connection portion 9*c*, and the third refrigerant flow path in this order, and is subjected to heat exchange with the gas flowing through first air passage AF1, and then, is subjected to heat exchange with the gas flowing through second air passage AF2.

A degree of dryness of the two-phase refrigerant flowing through the evaporator increases gradually from first flow inlet/outlet portion 5 toward second flow inlet/outlet portion 6. When the refrigerant is non-azeotropic mixed refrigerant, a temperature of the refrigerant having a high degree of dryness is higher than a temperature of the refrigerant having a low degree of dryness due to the above-described temperature gradient. Therefore, when the refrigerant is non-azeotropic mixed refrigerant, the temperature of the two-phase refrigerant flowing through the evaporator also increases gradually from first flow inlet/outlet portion 5 toward second flow inlet/outlet portion 6 due to the above-described temperature gradient.

In first heat exchanger 1A, the first group of first heat transfer tubes 3*a* through which the refrigerant having the lowest temperature flows are arranged leeward of the second group of first heat transfer tubes 3*b* through which the refrigerant having a higher temperature than that of the refrigerant flowing through the first group of first heat transfer tubes 3*a* flows. As a result, as shown in FIG. 3(*a*), on the windward side of first air passage AF1, heat exchange is performed between the refrigerant having a comparatively high temperature and the gas having a comparatively high temperature. Therefore, in first heat exchanger 1A, frost formation is suppressed on the windward side of first air passage AF1.

Furthermore, heat exchange with the refrigerant flowing through the second group of first heat transfer tubes 3*b* makes a temperature and a humidity of the gas flowing around the first group of first heat transfer tubes 3*a* lower than a temperature and a humidity of the gas flowing around the second group of first heat transfer tubes 3*b*. As a result, on the leeward side of first air passage AF1, heat exchange is performed between the refrigerant having a comparatively low temperature and the gas having a comparatively low temperature. Therefore, in first heat exchanger 1A, frost formation is suppressed on the leeward side of first air passage AF1.

In addition, a temperature of the non-azeotropic mixed refrigerant flowing through the second group of second heat transfer tubes 4*b* is higher than a temperature of the non-azeotropic mixed refrigerant flowing through the second group of first heat transfer tubes 3*b*. As a result, as shown in FIG. 3(*b*), on the windward side of second air passage AF2, heat exchange is performed between the refrigerant having a comparatively high temperature and the gas having a comparatively high temperature. Therefore, in first heat exchanger 1A, frost formation is also suppressed in second air passage AF2.

In addition, a temperature difference between the gas flowing through the windward side of second air passage AF2 and the gas flowing through the leeward side of second air passage AF2, i.e., an amount of decrease in temperature flowing through second air passage AF2 is comparatively small. Therefore, a sufficient degree of superheating (SH) of the refrigerant can be ensured.

That is, when first heat exchanger 1A functions as an evaporator, first heat exchanger 1A has high heat exchange performance while suppressing frost formation.

When first heat exchanger 1A functions as a condenser, the refrigerant having a high temperature and a high degree of dryness, which is discharged from compressor 101, flows into first heat exchanger 1A through second flow inlet/outlet portion 6. In first heat exchanger 1A, the refrigerant flows through the third refrigerant flow path, connection portion 9*c*, the fourth refrigerant flow path, flow path switching portion 7, the second refrigerant flow path, connection portion 8*c*, and the first refrigerant flow path in this order, and is subjected to heat exchange with the gas flowing through second air passage AF2, and then, is subjected to heat exchange with the gas flowing through first air passage AF1. As a result, the degree of dryness of the refrigerant decreases gradually.

Particularly when the refrigerant is non-azeotropic mixed refrigerant, the above-described temperature gradient makes a temperature of the refrigerant having a high degree of dryness higher than a temperature of the refrigerant having a low degree of dryness.

Figure 4:
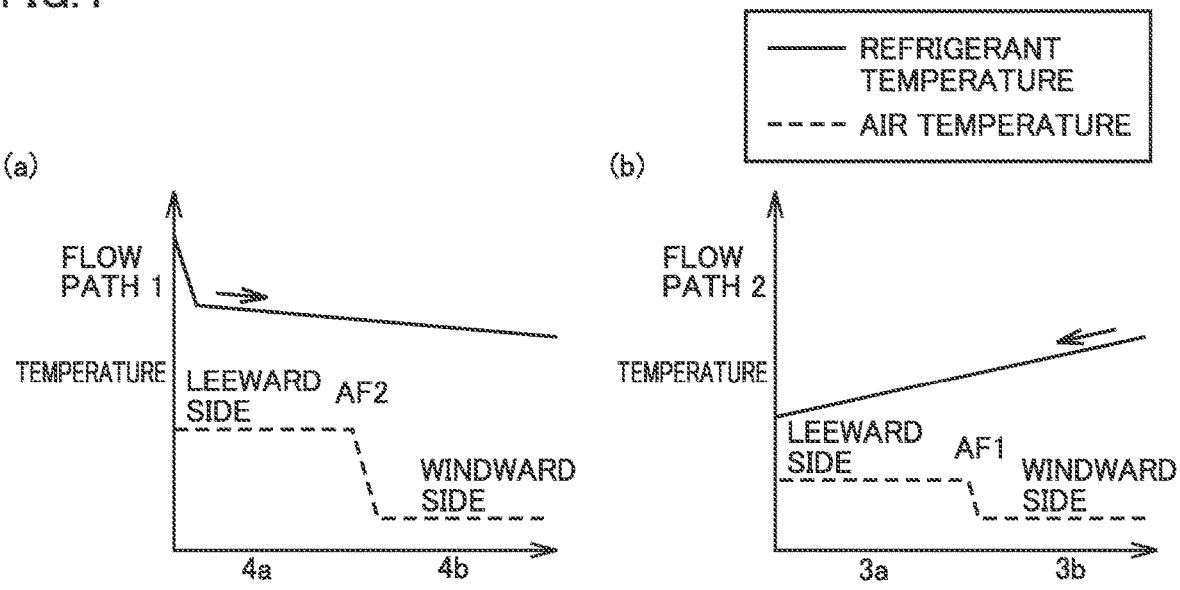
FIG. 4(*a*) is a graph showing temperature changes of the non-azeotropic mixed refrigerant and the air that are subjected to heat exchange in the second air passage of the heat exchanger when the heat exchanger according to the first embodiment functions as a condenser, and FIG. 4(*b*) is a graph showing temperature changes of the non-azeotropic mixed refrigerant and the air that are subjected to heat exchange in the first air passage of the heat exchanger when the heat exchanger according to the first embodiment functions as a condenser.

FIG. 4(*a*) is a graph showing temperature changes of the non-azeotropic mixed refrigerant flowing through the plurality of second heat transfer tubes 4 and the gas flowing through second air passage AF2, when the non-azeotropic mixed refrigerant flows through first heat exchanger 1A that functions as a condenser. FIG. 4(*b*) is a graph showing temperature changes of the non-azeotropic mixed refrigerant flowing through the plurality of first heat transfer tubes 3 and the gas flowing through first air passage AF1, when the non-azeotropic mixed refrigerant flows through first heat exchanger 1A that functions as a condenser. The horizontal axis in each of FIGS. 4(*a*) and 4(*b*) indicates a flow direction of the gas, with the right side of the horizontal axis corresponding to the windward side and the left side of the horizontal axis corresponding to the leeward side. The vertical axis in each of FIGS. 4(*a*) and 4(*b*) indicates temperatures of the non-azeotropic mixed refrigerant and the gas.

As shown in FIG. 4(*a*), the gas flowing through second air passage AF2 is first subjected to heat exchange with the refrigerant flowing through the second group of second heat transfer tubes 4*b*, and then, is subjected to heat exchange with the refrigerant flowing through the first group of second heat transfer tubes 4*a*. Therefore, a temperature of the gas flowing around the second group of second heat transfer tubes 4*b* becomes lower than a temperature of the gas flowing around the first group of second heat transfer tubes 4*a*. On the other hand, the above-described temperature gradient makes a temperature of the non-azeotropic mixed refrigerant flowing through the second group of second heat transfer tubes 4*b* lower than a temperature of the non-azeotropic mixed refrigerant flowing through the first group of second heat transfer tubes 4*a*. However, the temperature of the non-azeotropic mixed refrigerant flowing through the second group of second heat transfer tubes 4*b* is sufficiently higher than the temperature of the gas flowing around the second group of second heat transfer tubes 4*b*. As a result, in second air passage AF2, a temperature difference between the comparatively-low-temperature non-azeotropic mixed refrigerant flowing through the second group of second heat transfer tubes 4*b* and the comparatively-low-temperature gas flowing toward the second group of second heat transfer tubes 4*b*, and a temperature difference between the comparatively-high-temperature non-azeotropic mixed refrigerant flowing through the first group of second heat transfer tubes 4*a* and the comparatively-high-temperature gas flowing toward the first group of second heat transfer tubes 4*a* are both sufficiently large. Therefore, the heat exchange performance of first heat exchanger 1A is equal to or higher than the heat exchange performance of the above-described conventional heat exchanger.

First air passage AF1, and the first group of first heat transfer tubes 3*a* and the second group of first heat transfer tubes 3*b* arranged in first air passage AF1 function as a supercooling region that supercools the refrigerant whose degree of dryness is sufficiently decreased by flowing through the first group of second heat transfer tubes 4*a* and the second group of second heat transfer tubes 4*b* arranged in second air passage AF2. Particularly when the total sum of the lengths of the plurality of first heat transfer tubes 3 in first direction A is shorter than the total sum of the lengths of the plurality of second heat transfer tubes 4 in first direction A, a region of the plurality of first heat transfer tubes 3 that functions as a supercooling region increases.

Therefore, the heat exchange performance required for first air passage AF1, the first group of first heat transfer tubes 3*a* and the second group of first heat transfer tubes 3*b* is lower than the heat exchange performance required for second air passage AF2, the first group of second heat transfer tubes 4*a* and the second group of second heat transfer tubes 4*b*. In other words, a degree of influence of the heat exchange performance of first air passage AF1, the first group of first heat transfer tubes 3*a* and the second group of first heat transfer tubes 3*b* on the heat exchange performance of first heat exchanger 1A is lower than a degree of influence of the heat exchange performance of second air passage AF2, the first group of second heat transfer tubes 4*a* and the second group of second heat transfer tubes 4*b* on the heat exchange performance of first heat exchanger 1A. Therefore, the heat exchange performance of first heat exchanger 1A is not impaired by the heat exchange performance of first air passage AF1, the first group of first heat transfer tubes 3*a* and the second group of first heat transfer tubes 3*b*.

First heat exchanger 1A further includes first flow inlet/outlet portion 5 which is connected to the lower end of the first refrigerant flow path and through which the refrigerant flows in or out, connection portion 8*c* that connects the upper end of the first refrigerant flow path to the lower end of the second refrigerant flow path, and connection portion 9*c* that connects the upper end of the second refrigerant flow path to the lower end of the third refrigerant flow path.

With such a configuration, when first heat exchanger 1A functions as a condenser, the refrigerant flows through each of the first group of first heat transfer tubes 3*a*, the second group of first heat transfer tubes 3*b*, the second group of second heat transfer tubes 4*b*, and the first group of second heat transfer tubes 4*a* from bottom to top. The flow direction of the refrigerant flowing through the first group of first heat transfer tubes 3*a* and the flow direction of the refrigerant flowing through the second group of first heat transfer tubes 3*b* are the same. Therefore, unevenness between a temperature difference of the refrigerant flowing through one set of first heat transfer tube 3*a* and first heat transfer tube 3*b* arranged side by side in second direction B, and a temperature difference of the refrigerant flowing through another set of first heat transfer tube 3*a* and first heat transfer tube 3*b* arranged side by side with the one set in third direction C is smaller as compared with when the flow direction of the refrigerant flowing through the first group of first heat transfer tubes 3*a* and the flow direction of the refrigerant flowing through the second group of first heat transfer tubes 3*b* are opposite. Therefore, high heat exchange performance can be maintained in each of the one set of first heat transfer tube 3*a* and first heat transfer tube 3*b* arranged side by side in second direction B.

Refrigeration cycle apparatus 100 according to the first embodiment includes first heat exchanger 1A. When refrigeration cycle apparatus 100 is in the above-described first state, frost formation is suppressed in first heat exchanger 1A. Therefore, when refrigeration cycle apparatus 100 and a refrigeration cycle apparatus including the above-described conventional heat exchanger are used under the same condition, the number of times of defrosting operation per use time of is smaller in the former than in the latter. As a result, refrigeration cycle apparatus 100 achieves higher heat exchange performance and higher comfortability as compared with the conventional refrigeration cycle apparatus.

Second Embodiment

Figure 5:
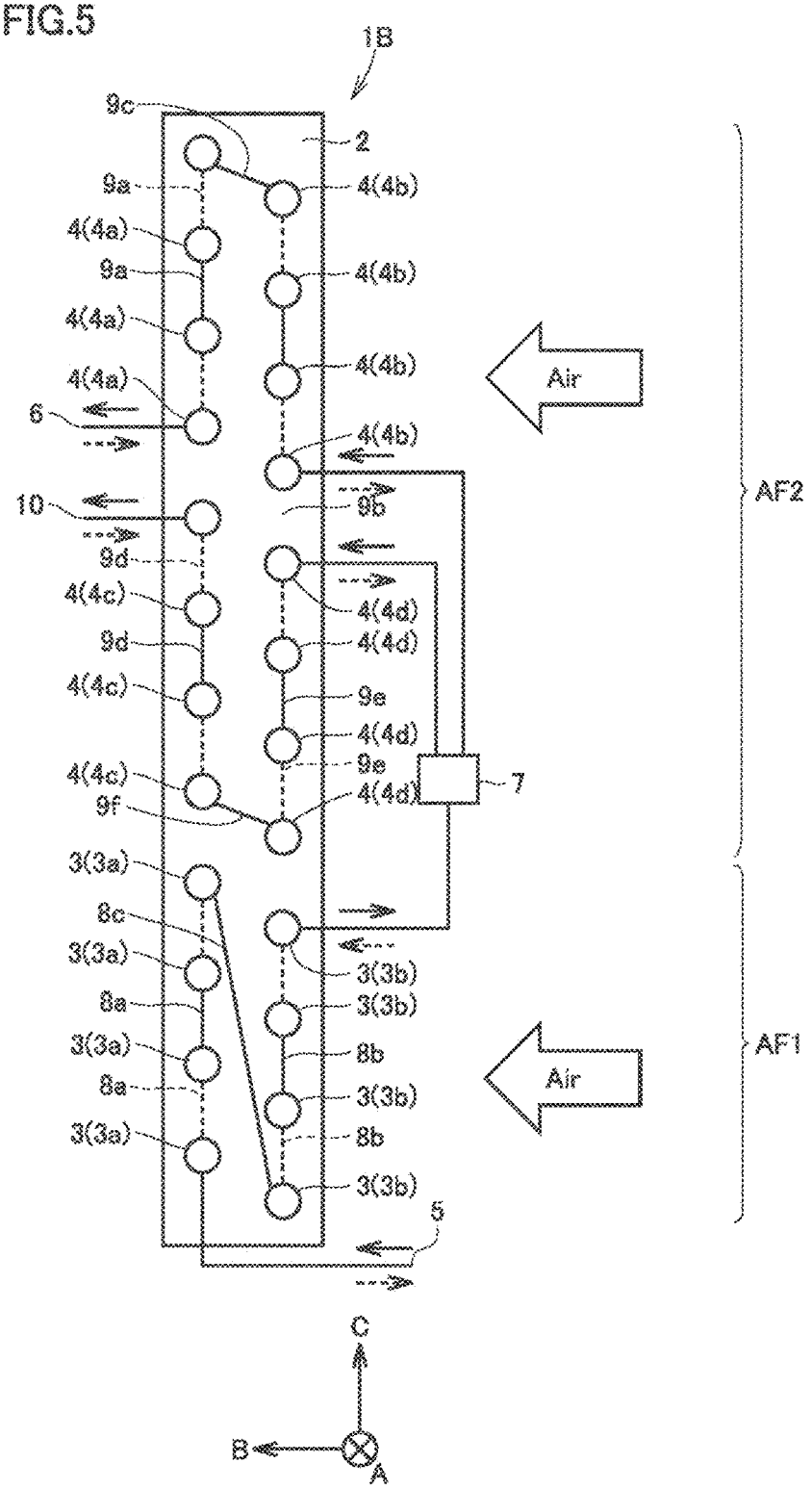
FIG. 5 is a side view showing arrangement of a plurality of heat transfer tubes of a heat exchanger according to a second embodiment.

As shown in FIG. 5, a first heat exchanger 1B according to a second embodiment is configured basically similarly to first heat exchanger 1A according to the first embodiment. However, first heat exchanger 1B according to the second embodiment is different from first heat exchanger 1A according to the first embodiment in that the plurality of second heat transfer tubes 4 further include a third group of second heat transfer tubes 4*c* and a fourth group of second heat transfer tubes 4*d*.

The third group of second heat transfer tubes 4*c* are arranged side by side in third direction C and connected to each other in series. The fourth group of second heat transfer tubes 4*d* are arranged side by side in the third direction and connected to each other in series.

The third group of second heat transfer tubes 4*c* are connected in series to the fourth group of second heat transfer tubes 4*d*, and arranged on the leeward side of second air passage AF2 relative to the fourth group of second heat transfer tubes 4*d* in second direction B. The third group of second heat transfer tubes 4*c* and the fourth group of second heat transfer tubes 4*d* are connected in parallel to the first group of second heat transfer tubes 4*a* and the second group of second heat transfer tubes 4*b*.

Each second heat transfer tube 4*c* of the third group of second heat transfer tubes 4*c* is arranged on the leeward side of second air passage AF2 relative to each second heat transfer tube 4*d* of the fourth group of second heat transfer tubes 4*d* in second direction B. Each second heat transfer tube 4*d* of the fourth group of second heat transfer tubes 4*d* is arranged on the windward side of second air passage AF2 relative to each second heat transfer tube 4*c* of the third group of second heat transfer tubes 4*c* in second direction B.

The third group of second heat transfer tubes 4*c* are spaced apart from and arranged side by side with the first group of second heat transfer tubes 4*a* in third direction C, and are spaced apart from the first group of first heat transfer tubes 3*a* in third direction C. The third group of second heat transfer tubes 4*c* are arranged below the first group of second heat transfer tubes 4*a* and arranged above the first group of first heat transfer tubes 3*a*.

The fourth group of second heat transfer tubes 4*d* are spaced apart from and arranged side by side with the second group of second heat transfer tubes 4*b* in third direction C, and are spaced apart from the second group of first heat transfer tubes 3*b* in third direction C. The fourth group of second heat transfer tubes 4*d* are arranged below the second group of second heat transfer tubes 4*b* and arranged above the second group of first heat transfer tubes 3*b*.

In first heat exchanger 1B, the first group of first heat transfer tubes 3*a*, the second group of first heat transfer tubes 3*b*, the second group of second heat transfer tubes 4*b*, and the first group of second heat transfer tubes 4*a* are connected in series in this order, and the first group of first heat transfer tubes 3*a*, the second group of first heat transfer tubes 3*b*, the fourth group of second heat transfer tubes 4*d*, and the third group of second heat transfer tubes 4*c* are connected in series in this order.

Second heat transfer tubes 4*c* of the third group of second heat transfer tubes 4*c* are connected to each other in series via connection portions 9*d*. Second heat transfer tubes 4*d* of the fourth group of second heat transfer tubes 4*d* are connected to each other in series via connection portions 9*e*. The third group of second heat transfer tubes 4*c* are connected in series to the fourth group of second heat transfer tubes 4*d* via a connection portion 9*f*.

The third group of second heat transfer tubes 4*c* and the plurality of connection portions 9*d* form a fifth refrigerant flow path. The fourth group of second heat transfer tubes 4*d* and the plurality of connection portions 9*e* form a sixth refrigerant flow path. The fifth refrigerant flow path is connected in series to the sixth refrigerant flow path via connection portion 9*f*.

In addition to first flow inlet/outlet portion 5 and second flow inlet/outlet portion 6, first heat exchanger 1B further includes a third flow inlet/outlet portion 10. Third flow inlet/outlet portion 10 is a portion through which the refrigerant flows into or out of the above-described refrigerant flow path of first heat exchanger 1B. Third flow inlet/outlet portion 10 is connected to second heat transfer tube 4*c* of the third group of second heat transfer tubes 4*c* located at an uppermost position. In other words, third flow inlet/outlet portion 10 is connected to an upper end of the fifth refrigerant flow path.

In first heat exchanger 1B shown in FIG. 5, connection portion 9*c* (second connection pipe) connects one ends or the other ends in first direction A of second heat transfer tube 4*a* of the first group of second heat transfer tubes 4*a* located at an uppermost position and second heat transfer tube 4*b* of the second group of second heat transfer tubes 4*b* located at an uppermost position.

The second group of first heat transfer tubes 3*b* are connected in series to the fourth group of second heat transfer tubes 4*d* via flow path switching portion 7. The second refrigerant flow path is connected in series to the sixth refrigerant flow path via flow path switching portion 7.

In first heat exchanger 1B, a refrigerant flow path in which the first refrigerant flow path, the second refrigerant flow path, the fourth refrigerant flow path, and the third refrigerant flow path are connected in series in this order, and a refrigerant flow path in which the first refrigerant flow path, the second refrigerant flow path, the sixth refrigerant flow path, and the fifth refrigerant flow path are connected in series in this order are formed.

A total sum of flow path cross-sectional areas of the plurality of second heat transfer tubes 4 is larger than a total sum of flow path cross-sectional areas of the plurality of first heat transfer tubes 3. The total sum of the flow path cross-sectional areas refers to a total sum of flow path cross-sectional areas of the plurality of first heat transfer tubes 3 and the plurality of second heat transfer tubes 4 that are seen in an arbitrary one cross section orthogonal to first direction A.

The features of the plurality of first heat transfer tubes 3 and the plurality of second heat transfer tubes 4 other than the above-described features are, for example, equal to each other. The flow path cross-sectional areas of the plurality of first heat transfer tubes 3 and the plurality of second heat transfer tubes 4 are, for example, equal to each other. The number of the third group of second heat transfer tubes 4*c* is, for example, equal to the number of the first group of second heat transfer tubes 4*a*. The number of the fourth group of second heat transfer tubes 4*d* is, for example, equal to the number of the second group of second heat transfer tubes 4*b*.

Since first heat exchanger 1B according to the second embodiment is configured similarly to first heat exchanger 1A according to the first embodiment, first heat exchanger 1B according to the second embodiment can produce an effect similar to that of first heat exchanger 1A.

When first heat exchanger 1A functions as an evaporator, the degree of dryness of the refrigerant flowing through the plurality of second heat transfer tubes 4 is higher than the degree of dryness of the refrigerant flowing through the plurality of first heat transfer tubes 3 as described above. Therefore, when the total sum of the flow path cross-sectional areas of the plurality of second heat transfer tubes 4 is, for example, equal to the total sum of the flow path cross-sectional areas of the plurality of first heat transfer tubes 3, a flow rate of the refrigerant flowing through the plurality of second heat transfer tubes 4 is higher than a flow rate of the refrigerant flowing through the plurality of first heat transfer tubes 3. In this case, a pressure loss of the refrigerant flowing through the plurality of second heat transfer tubes 4 is higher than a pressure loss of the refrigerant flowing through the plurality of first heat transfer tubes 3.

In contrast, in first heat exchanger 1B, the third group of second heat transfer tubes 4*c* and the fourth group of second heat transfer tubes 4*d* are connected in series to the first group of first heat transfer tubes 3*a* and the second group of first heat transfer tubes 3*b*, and are connected in parallel to the first group of second heat transfer tubes 4*a* and the second group of second heat transfer tubes 4*b*.

Therefore, even when the flow path cross-sectional areas of the plurality of first heat transfer tubes 3 and the plurality of second heat transfer tubes 4 are, for example, equal to each other, the total sum of the flow path cross-sectional areas of the plurality of second heat transfer tubes 4 is larger than the total sum of the flow path cross-sectional areas of the plurality of first heat transfer tubes 3. In this case, a flow rate of the refrigerant flowing through the plurality of second heat transfer tubes 4 is lower than that when the total sum of the flow path cross-sectional areas of the plurality of second heat transfer tubes 4 is equal to the total sum of the flow path cross-sectional areas of the plurality of first heat transfer tubes 3. As a result, even when the flow path cross-sectional areas of the plurality of first heat transfer tubes 3 and the plurality of second heat transfer tubes 4 are equal to each other, a pressure loss of the refrigerant flowing through the plurality of second heat transfer tubes 4 when first heat exchanger 1B functions as an evaporator can be reduced.

In first heat exchangers 1A and 1B according to the first and second embodiments, the plurality of first heat transfer tubes 3 may be configured differently from the plurality of second heat transfer tubes 4. For example, the flow path cross-sectional areas of the plurality of first heat transfer tubes 3 may be smaller than the flow path cross-sectional areas of the plurality of second heat transfer tubes 4.

In addition, in first heat exchanger 1B according to the second embodiment, connection portion 9*c* may connect one ends or the other ends in first direction A of second heat transfer tube 4*a* of the first group of second heat transfer tubes 4*a* located at a lowermost position and second heat transfer tube 4*b* of the second group of second heat transfer tubes 4*b* located at the uppermost position, similarly to first heat exchanger 1A. Similarly, connection portion 9*f* may connect one ends or the other ends in first direction A of second heat transfer tube 4*c* of the third group of second heat transfer tubes 4*c* located at a lowermost position and second heat transfer tube 4*d* of the fourth group of second heat transfer tubes 4*d* located at an uppermost position.

Although the embodiments of the present invention have been described above, the above-described embodiments can also be modified variously. In addition, the scope of the present invention is not limited to the above-described embodiments. The scope of the present invention is defined by the terms of the claims and is intended to include any modifications within the scope and meaning equivalent to the terms of the claims.

The invention claimed is:

1. A refrigeration cycle apparatus comprising a compressor, a flow path switching portion, a decompressing portion, a first heat exchanger, and a second heat exchanger, wherein the flow path switching portion is provided to perform switching between a first state and a second state, the first state being a state in which refrigerant flows through the compressor, the second heat exchanger, the decompressing portion, and the first heat exchanger in this order, the second state being a state in which the refrigerant flows through the compressor, the first heat exchanger, the decompressing portion, and the second heat exchanger in this order, the first heat exchanger exchanges heat between refrigerant flowing in a first direction and gas flowing in a second direction crossing the first direction, the first heat exchanger comprising:

a plurality of first heat transfer tubes and a plurality of second heat transfer tubes extending along the first direction; and at least one fin connected with each of the plurality of first heat transfer tubes and the plurality of second heat transfer tubes, and provided to form, around the plurality of first heat transfer tubes and the plurality of second heat transfer tubes, an air passage in which the gas flows in the second direction, the plurality of first heat transfer tubes comprising a first group of first heat transfer tubes and a second group of first heat transfer tubes, the first group of first heat transfer tubes being arranged side by side in a third direction crossing the first direction and the second direction, and connected to each other in series, the second group of first heat transfer tubes being arranged side by side in the third direction, and connected to each other in series, the first group of first heat transfer tubes being connected in series to the second group of first heat transfer tubes, and arranged leeward of the second group of first heat transfer tubes in the second direction, the plurality of second heat transfer tubes comprising a first group of second heat transfer tubes and a second group of second heat transfer tubes, the first group of second heat transfer tubes being arranged side by side in the third direction, and connected to each other in series, the second group of second heat transfer tubes being arranged side by side in the third direction, and connected to each other in series, the first group of second heat transfer tubes being connected in series to the second group of second heat transfer tubes, and arranged leeward of the second group of second heat transfer tubes in the second direction, the first group of first heat transfer tubes being arranged side by side with the first group of second heat transfer tubes in the third direction, and the second group of first heat transfer tubes being arranged side by side with the second group of second heat transfer tubes in the third direction, the first group of first heat transfer tubes, the second group of first heat transfer tubes, the second group of second heat transfer tubes, and the first group of second heat transfer tubes being connected in series in this order, the first group of first heat transfer tubes are arranged side by side with the first group of second heat transfer tubes in the third direction, the second group of first heat transfer tubes are arranged side by side with the second group of second heat transfer tubes in the third direction, the third direction is along a vertical direction, the first group of first heat transfer tubes are arranged below the first group of second heat transfer tubes, the second group of first heat transfer tubes are arranged below the second group of second heat transfer tubes, and in the first heat exchanger, the refrigerant flows through the first group of second heat transfer tubes, the second group of second heat transfer tubes, the second group of first heat transfer tubes, and the first group of first heat transfer tubes in this order in the second state, and the refrigerant flows through the first group of first heat transfer tubes, the second group of first heat transfer tubes, the second group of second heat transfer tubes, and the first group of second heat transfer tubes in this order in the first state.

2. The refrigeration cycle apparatus according to claim 1, wherein a total sum of lengths of the plurality of first heat transfer tubes in the first direction is shorter than a total sum of lengths of the plurality of second heat transfer tubes in the first direction.

3. The refrigeration cycle apparatus according to claim 1, further comprising:

a first flow inlet/outlet portion through which the refrigerant flows in or out, the first flow inlet/outlet portion being connected to a lower end of a first refrigerant flow path formed by connecting the first group of first heat transfer tubes in series; and a first connection pipe that connects an upper end of the first refrigerant flow path and a lower end of a second refrigerant flow path formed by connecting the second group of first heat transfer tubes in series, an upper end of the second refrigerant flow path is connected to a lower end of a third refrigerant flow path formed by connecting the second group of second heat transfer tubes in series.

4. The refrigeration cycle apparatus according to claim 3, further comprising:

a second connection pipe that connects an upper end of a fourth refrigerant flow path and a lower end of a third refrigerant flow path formed by connecting the first group of second heat transfer tubes in series; and a second flow inlet/outlet portion through which the refrigerant flows in or out, the second flow inlet/outlet portion being connected to an upper end of the third refrigerant flow path.

5. The refrigeration cycle apparatus according to claim 1, wherein the plurality of second heat transfer tubes further include a third group of second heat transfer tubes arranged side by side in the third direction and connected to each other in series, and a fourth group of second heat transfer tubes arranged side by side in the third direction and connected to each other in series, the third group of second heat transfer tubes are connected in series to the fourth group of second heat transfer tubes, and arranged leeward of the fourth group of second heat transfer tubes in the second direction, and the third group of second heat transfer tubes and the fourth group of second heat transfer tubes are connected in parallel to the first group of second heat transfer tubes and the second group of second heat transfer tubes.

6. The refrigeration cycle apparatus according to claim 2, further comprising:

a first flow inlet/outlet portion through which the refrigerant flows in or out, the first flow inlet/outlet portion being connected to a lower end of a first refrigerant flow path formed by connecting the first group of first heat transfer tubes in series; and a first connection pipe that connects an upper end of the first refrigerant flow path and a lower end of a second refrigerant flow path formed by connecting the second group of first heat transfer tubes in series, an upper end of the second refrigerant flow path is connected to a lower end of a third refrigerant flow path formed by connecting the second group of second heat transfer tubes in series.

7. The refrigeration cycle apparatus according to claim 2, wherein the plurality of second heat transfer tubes further include a third group of second heat transfer tubes arranged side by side in the third direction and connected to each other in series, and a fourth group of second heat transfer tubes arranged side by side in the third direction and connected to each other in series, the third group of second heat transfer tubes are connected in series to the fourth group of second heat transfer tubes, and arranged leeward of the fourth group of second heat transfer tubes in the second direction, and the third group of second heat transfer tubes and the fourth group of second heat transfer tubes are connected in parallel to the first group of second heat transfer tubes and the second group of second heat transfer tubes.

8. The refrigeration cycle apparatus according to claim 3, wherein the plurality of second heat transfer tubes further include a third group of second heat transfer tubes arranged side by side in the third direction and connected to each other in series, and a fourth group of second heat transfer tubes arranged side by side in the third direction and connected to each other in series, the third group of second heat transfer tubes are connected in series to the fourth group of second heat transfer tubes, and arranged leeward of the fourth group of second heat transfer tubes in the second direction, and the third group of second heat transfer tubes and the fourth group of second heat transfer tubes are connected in parallel to the first group of second heat transfer tubes and the second group of second heat transfer tubes.

9. The refrigeration cycle apparatus according to claim 4, wherein the plurality of second heat transfer tubes further include a third group of second heat transfer tubes arranged side by side in the third direction and connected to each other in series, and a fourth group of second heat transfer tubes arranged side by side in the third direction and connected to each other in series, the third group of second heat transfer tubes are connected in series to the fourth group of second heat transfer tubes, and arranged leeward of the fourth group of second heat transfer tubes in the second direction, and the third group of second heat transfer tubes and the fourth group of second heat transfer tubes are connected in parallel to the first group of second heat transfer tubes and the second group of second heat transfer tubes.

* * * * *